US009273548B2

(12) United States Patent
LeBLANC et al.

(10) Patent No.: US 9,273,548 B2
(45) Date of Patent: Mar. 1, 2016

(54) FIBEROPTIC SYSTEMS AND METHODS DETECTING EM SIGNALS VIA RESISTIVE HEATING

(71) Applicant: Halliburton Energy Services, Inc., Duncan, OK (US)

(72) Inventors: Michel J. LeBLANC, Houston, TX (US); Burkay Donderici, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 483 days.

(21) Appl. No.: 13/648,897

(22) Filed: Oct. 10, 2012

(65) Prior Publication Data

US 2014/0097848 A1 Apr. 10, 2014

(51) Int. Cl.
*G01V 3/00* (2006.01)
*E21B 47/06* (2012.01)

(52) U.S. Cl.
CPC ..... *E21B 47/06* (2013.01)

(58) Field of Classification Search
CPC ..... G01V 3/30; G01V 3/28; G01V 3/38; E21B 47/011
USPC ..... 324/333, 334, 338, 346, 351, 339, 239
See application file for complete search history.

(56) References Cited

U.S. PATENT DOCUMENTS 4,090,141 A 5/1978 Leblanc
4,222,261 A 9/1980 Leblanc et al.
4,348,587 A 9/1982 Tangonan et al.
4,376,248 A 3/1983 Giallorenzi et al.
4,433,291 A 2/1984 Yariv et al.
4,596,442 A * 6/1986 Anderson ..... G01F 1/28 116/275
4,622,460 A 11/1986 Failes et al.

(Continued)

FOREIGN PATENT DOCUMENTS

JP 2011069700 7/2011
WO WO2012005737 1/2012

(Continued)

OTHER PUBLICATIONS

Tumanski, Slawomir "Induction coil sensors-a review", Institute of Physics Publishing, Measurement Science and Technology. 18 (2007) R31-R46, (2007), 17 pgs.

(Continued)

*Primary Examiner* — Tung X Nguyen
*Assistant Examiner* — Dominic Hawkins
(74) *Attorney, Agent, or Firm* — Krueger Iselin LLP; Scott H. Brown

(57) ABSTRACT

Fiberoptics can be employed to detect downhole electromagnetic signals via resistive heating. A disclosed electromagnetic energy detector embodiment includes an optically-interrogated temperature sensor; and a conductive element thermally coupled to the sensor, the conductive element having a temperature response to incident electromagnetic energy. The optically-interrogated temperature sensor may be a length or coil of optical fiber to which a distributed acoustic sensing (DAS) or distributed temperature sensing (DTS) system is attached. The conductive element may be a metal coating on the fiber that experiences resistive heating in response to electromagnetic energy and creates an optically-measurable thermal response in the sensor.

25 Claims, 3 Drawing Sheets

(56) References Cited

U.S. PATENT DOCUMENTS

| | | | | |
|---|---|---|---|---|
| 4,868,495 | A | 9/1989 | Einzig et al. | |
| 4,918,371 | A | 4/1990 | Bobb | |
| 4,973,845 | A | 11/1990 | Mastrippolito et al. | |
| 5,047,741 | A * | 9/1991 | Laskaris | H01F 6/06 174/125.1 |
| 5,275,038 | A * | 1/1994 | Sizer | E21B 17/203 340/854.7 |
| 5,294,788 | A | 3/1994 | Charon et al. | |
| 5,305,075 | A | 4/1994 | Bucholtz et al. | |
| 5,402,069 | A * | 3/1995 | Tabanou | G01V 3/265 324/351 |
| 5,471,139 | A | 11/1995 | Zadoff | |
| 5,754,284 | A | 5/1998 | Leblanc et al. | |
| 6,289,740 | B1 | 9/2001 | Posey et al. | |
| 6,314,056 | B1 | 11/2001 | Bunn et al. | |
| 6,463,186 | B1 | 10/2002 | Li | |
| 6,724,469 | B2 | 4/2004 | Leblanc | |
| 6,747,743 | B2 | 6/2004 | Leblanc | |
| 6,957,576 | B2 | 10/2005 | Skinner et al. | |
| 7,243,718 | B2 * | 7/2007 | Chen | G01V 3/265 166/252.5 |
| 7,477,160 | B2 * | 1/2009 | Lemenager | E21B 47/122 166/336 |
| 7,747,388 | B2 | 6/2010 | Mombourquette et al. | |
| 8,379,438 | B2 * | 2/2013 | Tio Castro | H01L 45/06 365/106 |
| 2001/0023614 | A1 | 9/2001 | Tubel et al. | |
| 2003/0057950 | A1 | 3/2003 | Gao et al. | |
| 2004/0006429 | A1 | 1/2004 | Brown | |
| 2004/0140091 | A1 * | 7/2004 | Gupta | G01V 3/30 166/254.1 |
| 2005/0116718 | A1 * | 6/2005 | Chen | G01V 3/28 324/338 |
| 2006/0214098 | A1 | 9/2006 | Ramos | |
| 2007/0000912 | A1 * | 1/2007 | Aisenbrey | H05B 3/54 219/528 |
| 2008/0042636 | A1 | 2/2008 | Koste et al. | |
| 2008/0053702 | A1 * | 3/2008 | Smith, Jr. | E21B 7/14 175/50 |
| 2008/0210426 | A1 * | 9/2008 | Lembcke | E21B 47/011 166/302 |
| 2008/0241964 | A1 * | 10/2008 | Kaieda | G01N 33/54333 436/526 |
| 2009/0009174 | A1 * | 1/2009 | Forgang | G01V 3/28 324/338 |
| 2009/0268197 | A1 | 10/2009 | Perron et al. | |
| 2010/0134113 | A1 * | 6/2010 | DePavia | G01V 3/28 324/346 |
| 2011/0074428 | A1 * | 3/2011 | Wang | G01V 3/30 324/339 |
| 2011/0088462 | A1 | 4/2011 | Samson et al. | |
| 2011/0090496 | A1 | 4/2011 | Samson et al. | |
| 2011/0170112 | A1 | 7/2011 | Leblanc | |
| 2011/0298461 | A1 | 12/2011 | Bittar et al. | |
| 2011/0308788 | A1 | 12/2011 | Ravi et al. | |
| 2012/0013893 | A1 | 1/2012 | Maida et al. | |
| 2012/0014211 | A1 | 1/2012 | Maida et al. | |
| 2012/0205103 | A1 | 8/2012 | Ravi et al. | |
| 2014/0139226 | A1 | 5/2014 | Jaaskelainen et al. | |
| 2014/0191120 | A1 | 7/2014 | Donderici et al. | |

FOREIGN PATENT DOCUMENTS

| | | |
|---|---|---|
| WO | WO2012144977 | 10/2012 |
| WO | WO-2014/109816 | 7/2014 |

OTHER PUBLICATIONS

Donderici, Burkay "Compensated Cross-Well Tomography Methods and Systems", PCT Appl No. PCT/US2011/055020, filed Oct. 6, 2011, 19 pgs.

Donderici, Burkay, et al., Pulsed-Electric Drilling Systems and Methods with Formation Evaluation and/or Position Tracking, U.S. Appl. No. 13/564,230, filed Aug. 1, 2012, 23 pgs.

Hsu-Hsiang, Wu, et al., "Resistivity Logging Systems and Methods Employing Ratio Signal Set for Inversion", PCT Appl No. PCT/US2012/043937, filed Jun. 25, 2012, 27 pgs.

Donderici, Burkay, et al., "Multi-Axiat Induction Borehole Imager", PCT Appl No. PCT/US2012/044945, filed Jun. 29, 2012, 29 pgs.

Hsu-Hsiang, Wu, et al., "Tilted Antenna Loggings Systems and Methods Yielding Robust Measurement Signals", PCT Appl No. PCT/US2012/043943, filed Jun. 25, 2012, 30 pgs.

Donderici, Burkay, et al., "Full Tensor Micro-Impedence Imaging", PCT Appl No. PCT/US2012/044931, filed Jun. 29, 2012, 29 pgs.

Nie, Xiaochun, et al., "Multi-Array Laterolog Tools and Methods with Split Monitor Electrodes", PCT Appl No. PCT/US2012/046757, filed Jul. 15, 2012, 29 pgs.

Leblanc, Michel "Cementing Plug Tracking Using Distributed Strain Sensing", U.S. Appl. No. 13/562,456, filed Jul. 31, 2012, 19 pgs.

"PCT Written Opinion", dated Jan. 10, 2014, Appl No. PCT/US2013/064115, filed Oct. 9, 2013, 10 pgs.

"PCT Written Opinion", dated Feb. 17, 2014, Appl No. PCT/US2013/067285, "Fiberoptic Systems and Methods for Formation Monitoring," filed Nov. 29, 2013, 14 pgs.

"UK Examination Report", dated Feb. 5, 2014, Appl No. 1315987.6, "Fiberoptic Systems and Methods Detecting EM Signals Via Resistive Heating", filed Sep. 9, 2013, 6 pgs.

Campanella, Humberto et al., "Comparative performance of static-mode ferrous MEMS gradiometers fabricated by a three-step DRIE process", Journal of Micromechanics and Microengineering, vol. 20 No. 4, (May 21, 2010), 10 pgs.

"International Search Report and Written Opinion", dated Jan. 10, 2014, Appl No. PCT/US2013/064122, filed Oct. 9, 2013, 10 pgs.

Jaaskelainen, Mikko et al., "Optical Push-Pull Interferometric Sensors for Electromagnetic Sensing", Jaaskelainen, Mikko, et al., "Optical Push-Pull Interferometric Sensors for Electromagnetic Sensing", U.S. Appl. No. 13/679,940, filed Nov. 16, 2012, 34 pgs.

Maida, John L., et al., "Downhole Species Selective Optical Fiber Sensor Systems and Methods", Maida, John L., et al., "Downhole Species Selective Optical Fiber Sensor Systems and Methods", U.S. Appl. No. 13/253,788, filed Oct. 5, 2011, 23 pgs.

Maida, John L., et al., "Optical Casing Collar Locator Systems and Methods", Maida, John L., et al., "Optical Casing Collar Locator Systems and Methods", U.S. Appl. No. 13/226,578, filed Sep. 7, 2011, 30 pgs.

Mandviwala, Tasneem A., "Well Monitoring with Optical Electromagnetic Sensors", U.S. Appl. No. 13/679,926, filed Nov. 16, 2012, 28 pgs.

Ravi, Kris et al., "Downhole Fluid Tracking with Distributed Acoustic Sensing", "Downhole Fluid Tracking with Distributed Acoustic Sensing", U.S. Appl. No. 13/726,054, filed Dec. 22, 2012, 24 pgs.

Samson, Etienne M., et al., "Downhole Systems and Methods for Water Source Determination", Samson, Etienne M., Downhole Systems and Methods for Water Source Determination, U.S. Appl. No. 13/418,455, filed Mar. 13, 2012, 27 pgs.

San Martin, Luis E., et al., "Fiberoptic Systems and Methods for Subsurface EM Field Monitoring", U.S. Appl. No. 13/736,487, filed Jan. 8, 2013, 19 pgs.

Sharp, David P., et al., "Casing Collar Locator with Wireless Telemetry Support", Sharp, David P., et al., "Casing Collar Locator with Wireless Telemetry Support", U.S. Appl. No. 13/426,414, filed Mar 21, 2012, 30 pgs.

Skinner, Neal G., et al., "Downhole Time Domain Reflectometry with Optical Components", Skinner, Neal G., et al., "Downhole Time Domain Reflectometry with Optical Components", U.S. Appl. No. 13/655,607, filed Oct. 19, 2012, 32 pgs.

Vohra, S. T. et al., "Fiber-optic ac electric-field sensor based on the electrostrictive effect", Optic Letters, vol. 17, No. 5, Mar. 1, 1992, 3 pgs.

* cited by examiner

FIG. 1
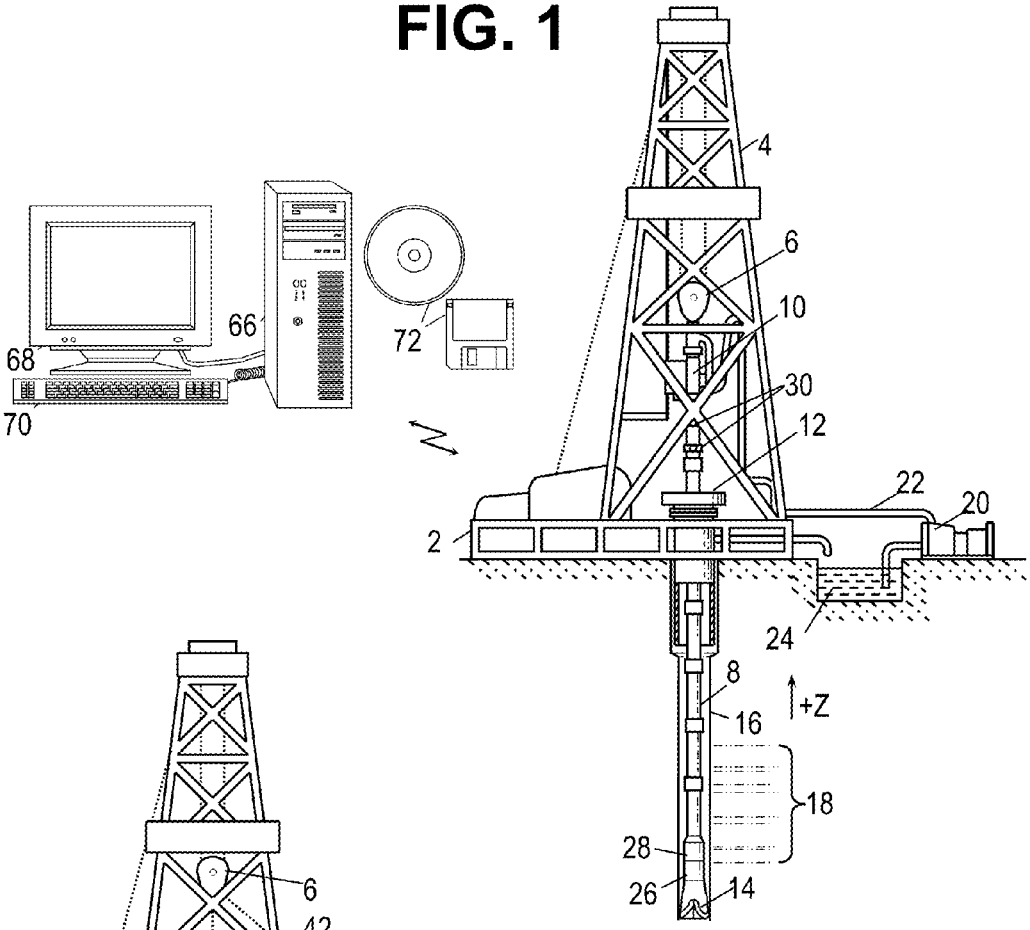
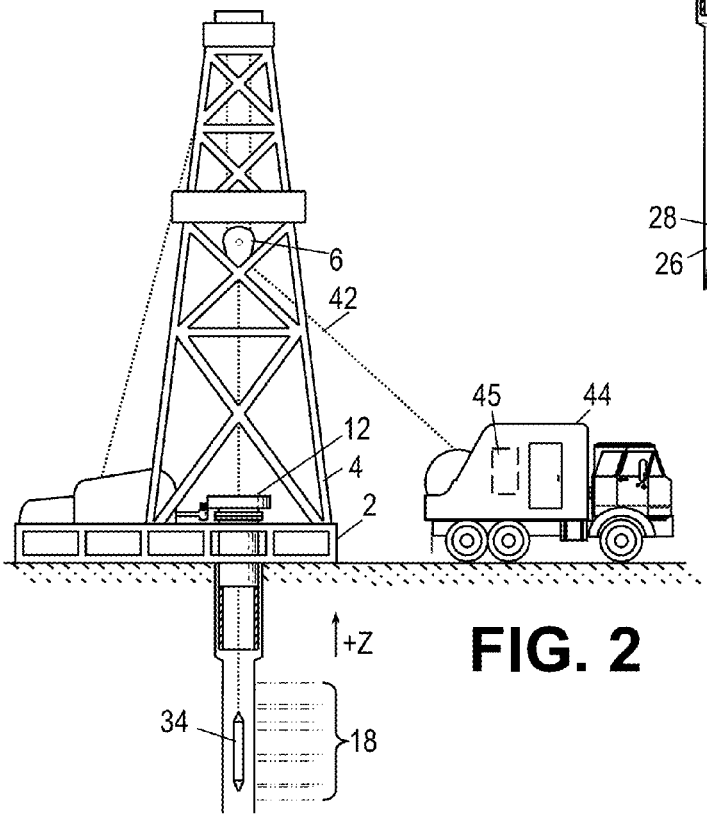
FIG. 2

FIG. 3
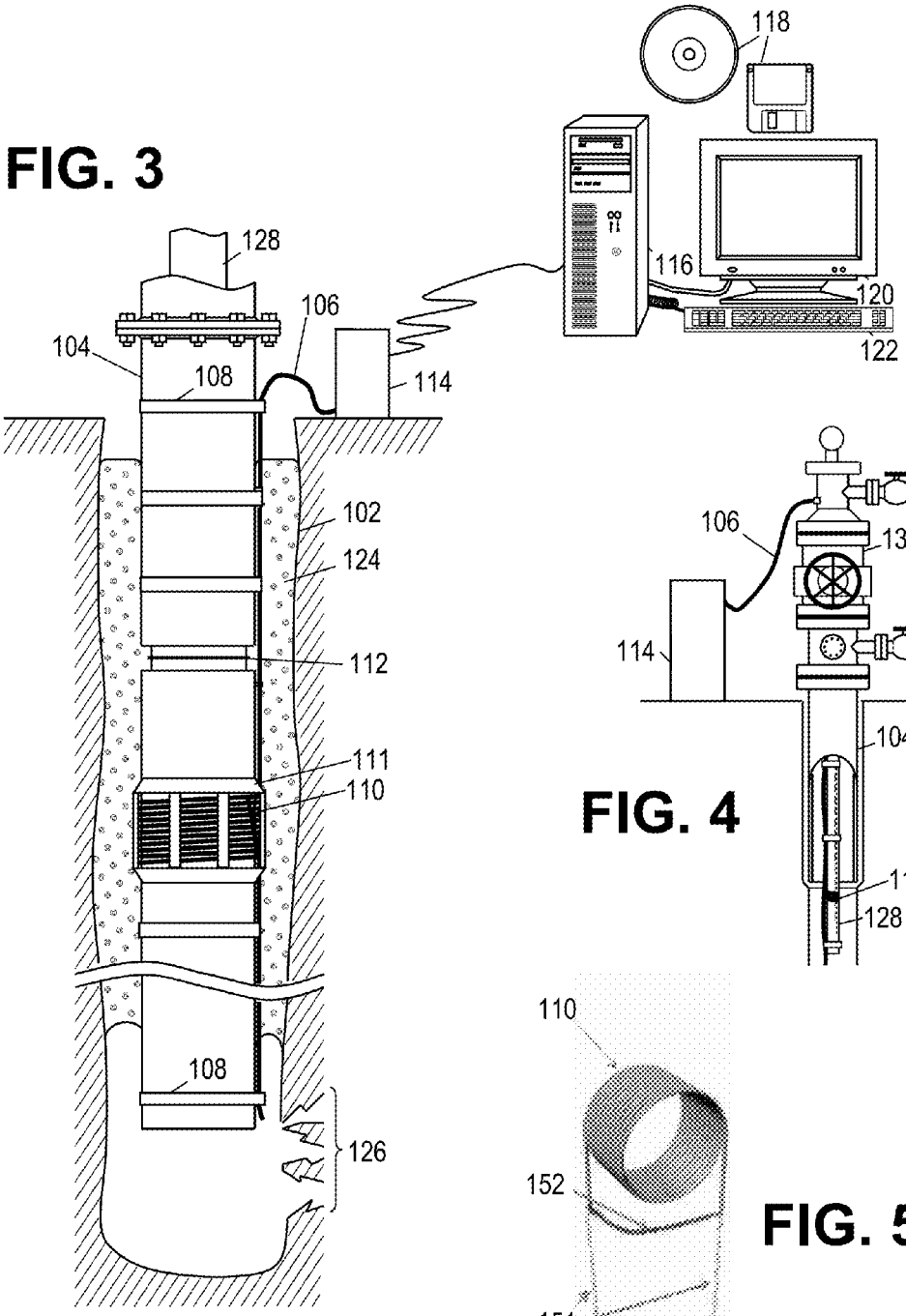
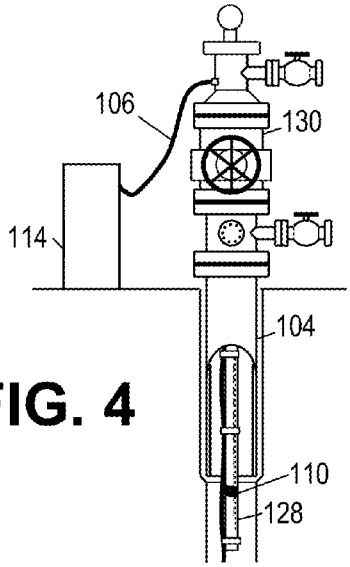
FIG. 4
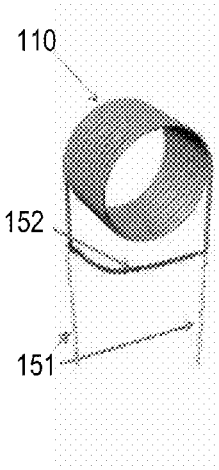
FIG. 5

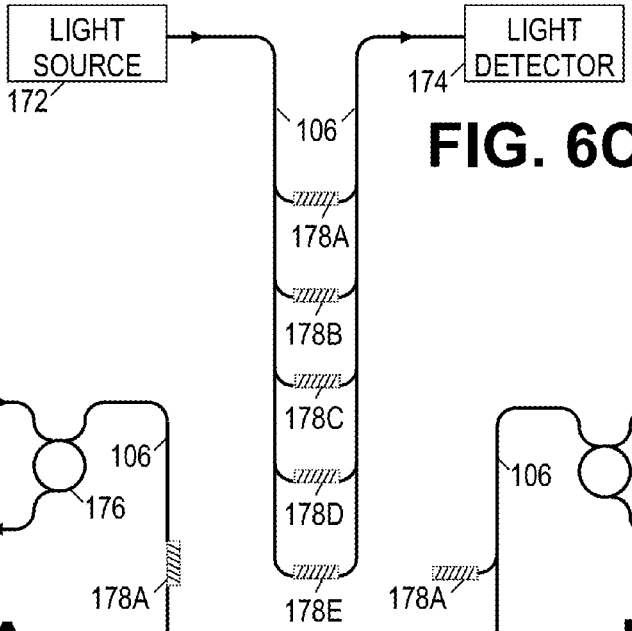
FIG. 6C
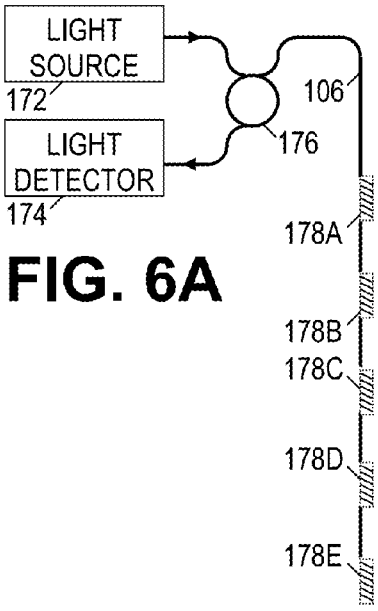
FIG. 6A
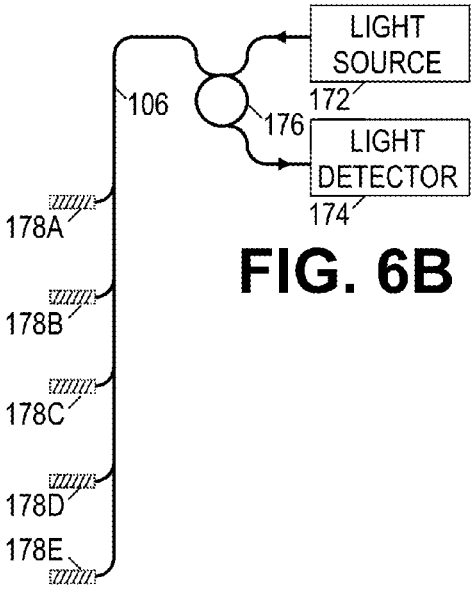
FIG. 6B
FIG. 7
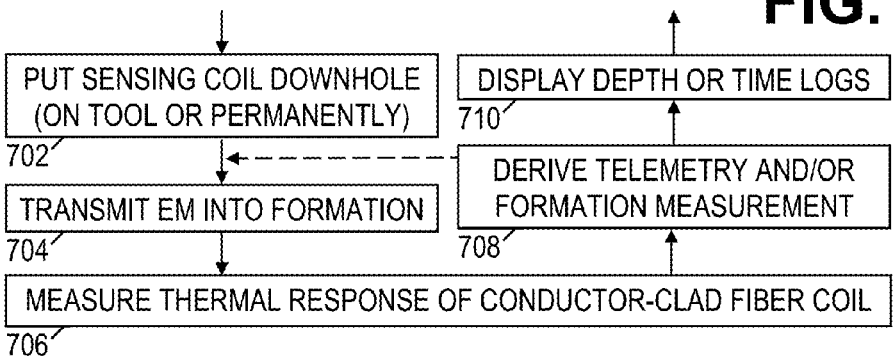

FIBEROPTIC SYSTEMS AND METHODS DETECTING EM SIGNALS VIA RESISTIVE HEATING

BACKGROUND

Modern oil field operators demand access to a great quantity of information regarding the parameters and conditions encountered downhole. Such information typically includes characteristics of the earth formations traversed by the borehole and data relating to the size and configuration of the borehole itself. The collection of information relating to conditions downhole, which commonly is referred to as "logging," can be performed by several methods including wireline logging and "logging while drilling" (LWD). A closely related information collection technique is "permanent monitoring".

In wireline logging, a sonde is lowered into the borehole after some or all of the well has been drilled. The sonde hangs at the end of a long wireline cable that provides mechanical support to the sonde and also provides an electrical connection between the sonde and electrical equipment located at the surface of the well. In accordance with existing logging techniques, various parameters of the earth's formations are measured and correlated with the position of the sonde in the borehole as the sonde is pulled uphole.

In LWD, the drilling assembly includes sensing instruments that measure various parameters as the formation is being penetrated, thereby enabling measurements of the formation while it is less affected by fluid invasion. While LWD measurements are desirable, drilling operations create an environment that is generally hostile to electronic instrumentation, telemetry, and sensor operations.

In permanent monitoring, sensing instruments are installed in a borehole for long-term monitoring of the downhole conditions. Such instruments must survive in a hostile environment for at least months if not years, and in most cases they are not accessible for repair or replacement. The instruments can be used to measure parameters in the borehole environment or in the formation surrounding the borehole.

One of the many formation parameters of interest is conductivity (or equivalently, resistivity). Many approaches to measure the resistivity of a formation downhole rely on the measurement of varying magnetic fields. The most familiar tool that works in this way is the electromagnetic induction sonde. This sonde combines both a transmitter coil and a receiver coil. The transmitter coil converts a varying electrical current into a varying magnetic field. This field excites eddy currents in the formation, which in turn generate varying (secondary) magnetic fields. Both the primary and the secondary magnetic fields present at the receiver coil location cause a time-varying electromotive force in the receiver coil. This voltage signal is received by the tool's electronics for further processing. The intensity and phase information of the received signal, analyzed in relation to the source signal, permit a determination of the resistivity of the formation in the zone interrogated by the tool. Because a varying magnetic field also implies a varying electric field, this approach is generally described as an electromagnetic (EM) interrogation method. Unfortunately, it may be difficult to provide receiver electronics of sufficient sensitivity that can survive a downhole environment for an extended period of time.

BRIEF DESCRIPTION OF THE DRAWINGS

Accordingly, there are disclosed herein various fiberoptic systems and methods for detecting electromagnetic signals via resistive heating. In the drawings:

FIG. 1 shows an illustrative environment for logging while drilling ("LWD").

FIG. 2 shows an illustrative environment for wireline logging.

FIG. 3 shows an illustrative environment for permanent monitoring.

FIG. 4 shows an alternative environment for permanent monitoring.

FIG. 5 is a model of an illustrative electromagnetic energy sensor.

FIGS. 6A-6C show illustrative architectures for distributed EM sensing.

FIG. 7 is a flow diagram of an illustrative EM sensing method.

It should be understood, however, that the specific embodiments given in the drawings and detailed description below do not limit the disclosure. On the contrary, they provide the foundation for one of ordinary skill to discern the alternative forms, equivalents, and other modifications that are encompassed in the scope of the appended claims.

DETAILED DESCRIPTION

The following disclosure presents a new type of receiver coil based on fiber optic technology, along with various suitable applications. The disclosed receiver coil permits the detection of electromagnetic (EM) signals with receiver electronics that are positioned at a considerable distance from the receiver coil. For example, when the disclosed technology is used in an induction sonde, all of the tool's electronics can be located at the surface, with only the transmitter coil and the fiber optic receiver coil positioned downhole. This approach is also suitable for permanent monitoring systems. For example, both source and receiver coil can be deployed behind casing and permanently reside in the well. Several receiver coils can be connected along the same optical fiber line and their signals separated at the surface based on a multiplexing/demultiplexing scheme. In a permanent monitoring system, the disclosed approach would be particularly well suited for water flood monitoring.

Turning now to the drawings, FIG. 1 shows an illustrative logging while drilling (LWD) environment. A drilling platform 2 is equipped with a derrick 4 that supports a hoist with a traveling block 6 for raising and lowering a drill string 8. The traveling block 6 suspends a top drive 10 suitable for rotating the drill string 8 and lowering the drill string through the well head 12. Connected to the lower end of the drill string 8 is a drill bit 14. As bit 14 rotates, it creates a borehole 16 that passes through various formations 18. A pump 20 circulates drilling fluid through a supply pipe 22 to top drive 10, down through the interior of drill string 8, through orifices in drill bit 14, back to the surface via the annulus around drill string 8, and into a retention pit 24. The drilling fluid transports cuttings from the borehole into the pit 24 and aids in maintaining the integrity of the borehole 16. Various materials can be used for drilling fluid, including an oil-based nonconductive mud.

A LWD tool suite 26 is integrated into the bottom-hole assembly near the bit 14. As the bit extends the borehole through the formations, logging tool 26 collects measurements relating to various formation properties as well as the tool orientation and various other drilling conditions. The LWD tools 26 may take the form of a drill collar, i.e., a thick-walled tubular that provides weight and rigidity to aid the drilling process. (For the present discussion, the set of logging tools is expected to include an induction logging resistivity tool to measure formation resistivity.) A telemetry sub 28 may be included to transfer measurement data to a surface receiver 30 and to receive commands from the surface. A computer or other processing system 66 processes the data and conveys it to a user via a display 68. An input device 70 enables the user to interact with the system and send commands to control the operation of the downhole instrumentation.

At various times during the drilling process, the drill string 8 may be removed from the borehole as shown in FIG. 2. Once the drill string has been removed, logging operations can be conducted using a wireline logging sonde 34, i.e., a probe suspended by a cable 42 having conductors for transporting power to the sonde and telemetry from the sonde to the surface. A wireline logging sonde 34 may have pads and/or centralizing springs to maintain the tool near the axis of the borehole as the tool is pulled uphole. Logging sonde 34 can include a variety of sensors including an induction logging tool for measuring formation resistivity. A logging facility 44 collects measurements from the logging sonde 34, and includes a computer system 45 for processing and storing the measurements gathered by the sensors.

An alternative data collection environment is shown in FIG. 3. A borehole 102 contains a casing string 104 with a fiber optic cable 106 secured to it by bands 108. At one or more points along the casing string, the fiber optic cable is wound in one (or several) coil(s) 110 around the casing string (or in one or more distinct coils outside of the casing) and protected by a nonmagnetic cage 111. As will be discussed in further detail below, the coil(s) 110 are configured as sensors for electromagnetic energy.

A transmitter 112 may be provided as a nearby source of electromagnetic energy. In some contemplated embodiments, the transmitter 112 is a magnetic dipole driven by a current from electrical conductors in cable 106. In other contemplated embodiments, a downhole source of energy such as a battery, fuel cell, and/or flow-driven generator, powers the transmitter 112. In still other embodiments, a tool may be lowered into the casing to act as a transmitter. Other contemplated alternatives include placing the transmitter in another borehole (e.g., for cross-well telemetry, cross-well tomography, or ranging while drilling), or positioning an array of transmitters on the surface.

Cement 124 is pumped into the annulus and allowed to set, permanently securing the casing in place and preventing fluid flows along the annular region. Perforations and/or fractures 126 have been created in the bottomhole region to facilitate fluid inflow from the formation. A production tubing string 128 has been provided inside the casing 104 to guide the desired fluid (e.g., oil or gas) from the bottom of the borehole to the surface. Note that this well configuration is merely illustrative and not limiting on the scope of the disclosure.

The cable 106 is coupled to a surface interface 114. Surface interface 114 includes an optical port for coupling the optical fiber(s) in cable 106 to a light source and a detector. The light source transmits pulses of light along the fiber optic cable, including any coil(s) 110. Optical fiber(s) scatter some of the transmitted light back along the fiber to the detector, the scattering occurring in a manner indicative of the fiber temperature. The detector responsively produces an electrical output signal indicative of the disturbances along the fiber, including those caused by temperature changes. Commercial systems for such "distributed acoustic sensing" are known and readily available in the marketplace. (However, such systems are not believed to have been applied in the manner disclosed herein to detect rapid temperature changes). Such systems can also provide distributed temperature sensing, enabling the temperature profile of the well to be monitored.

Distributed temperature sensing (DTS) and distributed acoustic sensing (DAS) systems generally operate based on measurements of backscattered light from scattering sites along the length of the fiber. Such backscattered light has properties indicative of temperature and stress at the scattering location. The surface interface transmits light pulses and measures the properties of the backscattered light as a function of time. Combined with knowledge of the light's propagation velocity in the fiber, such measurements can be readily converted to position-dependent measurements of temperature (for DTS) or acoustically-induced strain in the fiber (for DAS). These measurements may be made on the optical fibers coupling the surface interface to the downhole sensors, or they can be made on separate optical fibers provided within cable 106. Where separate fibers are used, an additional light source and detector can be employed, or the existing source and detector may be switched periodically between the fibers.

The illustrative downhole optical sensor system of FIG. 3 further includes a computer 116 coupled to the surface interface 114 to control the light source and detector, and to receive and process the signals indicative of disturbance versus position along the fiber. The illustrated computer 116 includes an output device 120 (e.g., a monitor as shown in FIG. 3, or a printer), an input device 122 (e.g., a keyboard or a mouse), and information storage media 118 (e.g., magnetic or optical data storage disks). However, the computer may be implemented in different forms including, e.g., an embedded computer permanently installed as part of the surface interface 114, a portable computer that is plugged into the surface interface 114 as desired to collect data, a remote desktop computer coupled to the surface interface 114 via a wireless link and/or a wired computer network, a mobile phone/PDA, or indeed any electronic device having a programmable processor and an interface for I/O.

The computer 116 is adapted to receive the electrical output signal produced by the surface interface 114 and to responsively extract a thermal response of the sensor(s) 110 to incident electromagnetic radiation, from which additional information can be derived (e.g., spectral information including attenuation and phase shift of the EM energy, formation conductivity, formation permittivity, and telemetry modulated on the EM signal). The software program executed by the computer 116 may, for example, embody an inversion model for deriving formation properties from EM attenuation and phase measurements. The information storage media 118 may store a software program for execution by computer 116 to derive the desired information. The instructions of the software program may cause the computer 116 to collect information regarding downhole conditions including, e.g., configuration and location of the transmitter(s) and receiver(s). The instructions of the software program may also cause the computer 116 to communicate to the user the derived information and rate of change associated therewith (e.g., conductivity changes due to an approaching water front or drillstring) via the output device 120. Note that the information can be communicated via a graphical output device, via email or SMS text, via an audible or visual alarm indicator, or indeed by any suitable output technique.

FIG. 4 shows a related optical system embodiment in which the sensing coil 110 is wound around, or attached to the exterior of, the production tubing string 128 rather than the casing string. The cable 106 is banded to the production tubing as the tubing is inserted into the well. At the surface, a feedthrough in production well head 130 enables the cable 106 to connect to the surface interface 114.

FIG. 5 shows a model of the electromagnetic sensor with an optical fiber 151 wound into a sensing coil 110. The portion of the optical fiber in coil 110 is provided with a conductive coating with the two ends connected via a jumper (short circuit) 152. The conductive coating may be covered with a thin insulator (e.g., polymide) to prevent adjacent loops of the coil from being in electrical contact, thereby forcing any current flow to move around the coil circumference rather than directly along the coil axis. Changes in magnetic flux along the coil axis will induce current flows in the conductive coating, in turn causing resistive heating of the optical fiber. Ferromagnetic or other high magnetic susceptibility materials may be provided inside the coil to concentrate the magnetic flux and thereby amplify the coil's thermal response to changing magnetic fields. The magnetic material can partially or fully occupy the inside area of the coil. It can be of cylindrical or any other shape. As an example a magnetic susceptibility material core with $\mu_r$=1000 can amplify the signal by 1000 with the relationship getting closer to linear as frequency approaches zero.

The lead-in and lead-out portions of the optical fiber are preferably not metal-coated, to limit capacitive and self-inductive effects. A varying electromagnetic field will, by Faraday's law of induction, generate an electromotive force (EMF) in the coil that, because of the short between ends of the coil, causes a time varying current in the coil. The conductive coating has a small, but nonzero, resistance that causes resistive heating in response to a current flow. This resistive heating raises the temperature of the optical fiber by a small amount. The temperature change is directly related to the current and it causes a dimensional change in the fiber (due to thermal expansion) and also causes a change in the index of refraction of the fiber. Both these effects affect optical path length associated with the coil, causing a phase change that is detectable with an interferometer or a wavelength change of a fiber Bragg grating element along the fiber. In any case, the changes in the optical signal are detectable by an interrogating electro-optic system which can be positioned several thousands of meters away from the receiver coil.

The conductive coating for the fiber can be a metal (e.g., gold or silver), or some other conductive material. The conductive coating can be replaced with a wire mesh layer or even conductive tubing through which the fiber passes. In alternative embodiments, the conductive element may simply be a wire that is co-wound in close (thermal) contact with the optical fiber. In general, any conductor supporting loop currents in response to varying EM fields can be used, though it is preferred that the conductor have a good thermal response to the resistive heating. Such a thermal response may necessitate a small thermal mass with good thermal connectivity to the fiber.

The performance of the sensor depends on many parameters which can be selected or adjusted to provide the response desired. Those parameters include the following: The length of the fiber in the coil, because the optical path length change is proportional to the length of the fiber. Of course this length is also dependent on the coil diameter and the number of turns in the coil. The number of turns and coil diameter, together with magnetic susceptibility of the core, further relate to the relationship between the magnetic field change and the induced EMF. Size limitations on the sensor may at least partly be addressed by varying the length of the coil by varying the number of winding layers, though self-inductance is a consideration and should be minimized.

Another approach to meeting size limitations includes selecting smaller fiber diameters, though as a practical matter the glass fiber is available only in standard diameters such as 125 micrometers or 80 micrometers. The thickness of the coating can also be varied somewhat, though manufacturing considerations come into play. In practice, outer diameters of the coating may be limited to standard values such as 155 micrometers. The outermost fiber coating (e.g., polymide insulation) further adds to the fiber diameter.

The choices of materials (conductive coating, insulator) should consider the thermal response. Resistive heating theoretically improves with reduced resistance, at least until the resistance becomes comparable to the coating's reactance in the frequency range of interest. (Gold may be a better choice than aluminum.) The insulator should have a low heat capacity while providing limited heat dissipation to enhance the sensor's thermal response to varying magnetic fields.

The optical path length change of a sensing coil can be expressed in terms of a phase change:

$$\Delta\phi(t)=K_T(2n\pi L/\lambda)\Delta T(t), \tag{1}$$

where $K_T$ is a temperature coefficient of the fiber, $\phi=(2n\pi L/\lambda)$ is a phase delay of the coil calculated from index of refraction n, fiber length L, and light wavelength $\lambda$. The temperature change is expressible as:

$$\Delta T(t) = \frac{(NB_0\omega\cos(\theta))^2 r_{coil}^3[\cos(\varphi) + K_f(\omega)\cos(\phi + 2\omega t)]}{8\ hr_{coat}\sqrt{R_{coil}^2 + \omega^2 L_{coil}^2}}, \tag{2}$$

where N is the number of turns in the coil, $B_0$ is the magnetic flux, $\omega$ is the angular frequency of the magnetic field variation, $\theta$ is the angle between the magnetic field vector and the coil axis, $r_{coil}$ is the coil radius, h is the convection coefficient, $r_{coat}$ is the outer radius of the conductive coating on the fiber, and the power factor:

$$\cos(\varphi) = \frac{R_{coil}}{\sqrt{R_{coil}^2 + \omega^2 L_{coil}^2}}, \tag{3}$$

accounts for the coil's self inductance $L_{coil}$, where $R_{coil}$ is the resistance of the coil. The thermal mass attenuation is expressible:

$$K_f = \frac{h}{h + \omega\rho C_p r_{coat}}, \tag{4}$$

where $\rho$ is the fiber density and $C_p$ is the heat capacity of the fiber. Note that the bracketed term equation (2) provides both a steady-state (DC) response to the incident EM energy and an AC response at twice the frequency of the incident EM energy.

For reasonable parameter estimates ($K_T=8\times10^{-6}$ rad/K, n=1.5, $B_0=10^{-6}$ T, $r_{coil}$=0.2 m, $r_{coat}$=72.5 μm (gold), L=$10^3$ m, h=100 W/m$^2$K), the modeled AC component of the steady state thermal response has an amplitude of about $1.8\times10^{-6}$ rad when the frequency of the incident field is above about 2 kHz. The DC temperature shift is nearly linear with frequency (using an effective thermal insulation over the fiber, modeled as a reduced convection coefficient of h=1 W/m$^2$K), with a slope of about $10^{-7}$ K/Hz. At feasible operating frequencies, DC component sensing would likely require a ferromagnetic core with a relative susceptibility above 5000. Distributed temperature sensing systems may have a resolution of about 0.1K, making a shift of at least 1K desirable. Single-point sensors (e.g., Bragg gratings) may have resolutions as small as 0.01K or better.

FIGS. 3-5 show only one sensor coil, but the system may employ multiple coils. Illustrative multi-coil architectures are shown in FIGS. 6A-6C. In each of these figures, a light source 172 and light detector 174 are coupled to optical fiber in cable 106. In FIGS. 6A-6B, the optical fiber supports two-way communication, so a circulator 176 couples the source 172 and detector 174 to cable 106. Other architectures (like that shown in FIG. 6C) employ separate fibers for downgoing and upgoing signals.

FIG. 6A shows an inline system in which the sensing coils 178A-178E are connected in series. By contrast, FIGS. 6B and 6C show branched systems in which some of the light from a trunk fiber is diverted into a branch containing one of the sensing coils. (Both inline and branched architectures can employ one-way (transmissive sensing) or two-way (reflective or scattered sensing) configurations. Such diversion can be accomplished with the use of optical splitters that direct a portion of the light (e.g., 2%) to the corresponding sensor and passes the remainder further along the cable. The splitters also recombine returning light from the sensor with light returning to the surface along the trunk. Due to travel time differences, a downgoing pulse gets converted into a series of upgoing pulses, the first pulse associated with sensor 178A, the second with 178B, etc.

Where the fiber optic cable 106 includes multiple optical fibers or multi-stranded optical fibers, the optical sensors 178A-178E can be directly coupled to different ones of the optical fibers or strands. The optical splitters would not be needed in this variation. The detector 174 can be coupled to measure the total light returned along the multiple fibers or strands, as the travel time difference to the various sensors will convert the transmitted light pulse into a series of reflected light pulses, with each pulse representing a corresponding optical sensor measurement.

The two-way in-line configuration of FIG. 6A is suitable for optical scattering measurements of the type employed by commercially available distributed temperature sensing (DTS) and distributed acoustic sensing (DAS) systems. This configuration may be preferred for its ability to support multiple types of measurements including temperature, acoustic, and EM sensing.

Alternatively, fiber Bragg grating sensors can be incorporated into the sensing coils, with the EM sensing performed by monitoring the center frequencies of the grating sensors. Such sensing can be performed using any of the inline/branched one-way/two-way architectures. In the inline architectures, the gratings employ different center frequencies. That is, each of the sensors 178 is adapted to alter (e.g., attenuate) light in a distinct range of wavelengths (i.e., band of frequencies) such that the optical sensors 178 alter light in different wavelength ranges (i.e., frequency bands) while leaving the other wavelengths largely unaffected.

The light source 172 may produce light having components in each of the wavelength ranges corresponding to the optical sensors 178. As the light propagates along the fiber optic cable and through the optical sensors 178, each of the optical sensors alter the light components within their associated wavelength range. In the embodiment of FIG. 6A, the light reflects from the end of the cable and propagates back to the surface, passing a second time through each of the sensors which further alter (e.g., attenuate) the light component in their associated wavelength range. When the reflected light reaches the surface interface, the optical circulator 176 directs the reflected light to the light detector 174, which analyzes each of the wavelength ranges associated with the various sensors 178 to determine a measurement for each sensor.

The embodiment shown in FIG. 6C is similar to the embodiment of FIG. 6B. Rather than using a single optical fiber for both downward-going and upward-going light, however, the embodiment of FIG. 6C separates the downward-going light path from the upward-going light path. Though both paths may be contained in a single fiber optic cable, the two light paths are carried on separate fibers. Light pulses from source 172 travel downward, are distributed to the optical sensors 178 as provided previously, and reach the detector 174 via a separate path. Travel time differences will produce a series of light pulses at the detector, each pulse corresponding to a different optical sensor. Alternatively, or in addition, the optical sensors may operate in different wavelength bands and the sensor measurements may be distinguished accordingly. A similar modification can be made to the embodiment of FIG. 6A to return the light along a separate upgoing path.

FIG. 7 is a flowchart of summarizing certain illustrative embodiments of the disclosed EM sensing methods. In block 702, one or more sensing coils is placed downhole, either as part of a logging tool or as a permanent sensor mounted on a casing string or tubing string. In block 704, electromagnetic energy is transmitted by, e.g., a surface array, a nearby transmitter in the borehole, or a transmitter in a nearby borehole. The electromagnetic energy can, if desired, be modulated with telemetry information. Contemplated modulation techniques include amplitude modulation, quadrature amplitude modulation, phase modulation, and multi-carrier modulation.

In block 706, the thermal response of the sensing coil(s) is measured to detect the electromagnetic energy reaching the coil. The thermal response is detectable via the optical fiber due to the change in optical path length associated with the change in temperature. In block 706, the information conveyed by the EM energy is extracted. Where telemetry modulation is employed, the telemetry data can be extracted from the measured thermal response. Where the attenuation and/or phase of the EM energy is indicative of formation parameters, the attenuation and/or phase can be measured and used to determine the formation parameters. Blocks 704-706 are repeated as needed to, e.g., derive a log of formation properties as a function of tool position and/or as a function of time. In block 710, the derived information is displayed to a user, e.g., in to form of a position or time-dependent log of formation properties.

The foregoing disclosure enables an all-fiber approach to the detection of EM signals downhole, requiring no electronics (other than wiring for a transmit antenna) downhole. The disclosed systems are suitable for use with permanent, long-term monitoring installations. The disclosed sensing coils do not require sophisticated materials or intricate manufacturing approaches. Coils can be manufactured using well-understood metal coating techniques and manufacturing methods (including spool winding). Many parameters are customizable to adjust the performance of the sensor, including, e.g., the wound fiber length, and coil axial length. Well known EM communication and logging principles can be exploited to derive the desired information from the received EM signals. The disclosed sensing techniques do not require DC biasing or any compensation for the Earth's magnetic field or other permanent magnetic fields that may be present in the wellbore.

The disclosed systems and methods can be modified and adapted for use in varied systems and contexts. With the advent of wired drillpipe and composite tubing having embedded information conduits, the cable 106 can be omitted in favor of conductors and optical fibers embedded in the wall of the tubing string. Such embedded wiring/fiber may further be used to form the disclosed sensing coils. In other embodiments, the light source and/or light detector may be positioned downhole and coupled to the surface interface via electrical conductors.

The illustrated sensing coils have been shown in a coaxial orientation. It is contemplated that the sensing coils can be offset (i.e., positioned next to the tubing string rather than enclosing the tubing string). It is further contemplated that the sensing coils can be tilted relative to the tubing string axis. See, e.g., Hagiwara and Song, U.S. Pat. No. 6,181,138, for illustrative tilted antenna coil configurations for multi-axial measurements. In some instances, the sensing coils may even be positioned transverse to the axis of the tubing string. Tilted and transverse multi-axial coil configurations enable the measurements to be obtained with directional sensitivity, and may further enable determination of additional formation parameters such as relative dip, azimuth, and resistive anisotropy.

Contemplated applications for the disclosed sensing coils include: use as a receiver coil in an induction tool, enabling the electronics to be located on the surface rather than downhole, and further enabling reduction of cable size and weight due to the use of fiberoptics, which in turn may enable deeper reach; use as a permanent sensor installed in a wellbore as part of a flood monitoring system; use as a permanent sensor installed in a wellbore as part of a crosswell EM monitoring system; use as a fixed location sensor to provide positive confirmation of the proximity of a casing collar locator (CCl) tool; use as a receiver of a short-hop telemetry system; and use as a receiver for a well-intervention or well-avoidance or SAGD ranging system. The sensing coils can be interrogated via a host of techniques including: interferometric detection (e.g., Michelson, Mach-Zender, or cavity style Fabry-Perot); distributed acoustic sensing; distributed temperature sensing (to detect the DC component); fiber Bragg grating sensor inscribed at one or more location within the coils; inclusion of an active material (such as Erbium-doped fiber) and reflector elements (Bragg gratings) at one or more locations to create fiber laser sensors whose wavelength, or intensity would fluctuate with the induced temperature change.

Numerous other variations and modifications will become apparent to those skilled in the art once the above disclosure is fully appreciated. It is intended that the following claims be interpreted to embrace all such variations and modifications.

What is claimed is:

1. A formation conductivity sensor that comprises:

a transmitter that radiates electromagnetic energy into a subsurface formation;

a receiver having:

one or more loops of an optical fiber thermally coupled to a surrounding conductive element to yield an optically-detectable thermal response to electromagnetic energy from the formation, said electromagnetic energy inducing an electrical current in the conductive element along the one or more loops and through an electrical short across the ends of the one or more loops, and said thermal response resulting from the electrical current; and an optical source and optical detector that measure said thermal response; and a processing unit that derives a measure of formation conductivity from said thermal response.

2. The sensor of claim 1, wherein the processing unit extracts an AC response at twice a frequency of the radiated electromagnetic energy.

3. The sensor of claim 1, wherein the measure of formation conductivity is based at least in part on a phase of the thermal response relative to the radiated electromagnetic energy.

4. The sensor of claim 1, wherein the measure of formation conductivity is based at least in part on an attenuation of the radiated electromagnetic energy.

5. The sensor of claim 1, wherein the transmitter and receiver are spaced apart in a borehole.

6. The sensor of claim 5, wherein the one or more loops are wound on a casing string.

7. The sensor of claim 5, wherein the one or more loops are wound on a production tubing string.

8. The sensor of claim 5, wherein the one or more loops are wound on a drill string.

9. The sensor of claim 5, wherein the one or more loops are attached to a casing string, production tubing string, or drill string, without enclosing said string.

10. The sensor of claim 5, wherein the one or more loops are part of a wireline logging tool.

11. A method comprising:

transmitting electromagnetic energy into a formation, thereby inducing an electrical current into a shorted looped segment of a conductively-clad optical fiber in a borehole of the formation in response to the electromagnetic energy;

detecting a thermal response of the conductively-clad optical fiber produced by the electrical current; and deriving information from the thermal response.

12. The method of claim 11, wherein the information is telemetry data modulated onto the electromagnetic energy.

13. The method of claim 12, wherein the electromagnetic energy is transmitted from a borehole other than the borehole in which the optical fiber is positioned.

14. The method of claim 11, wherein the information is a measure of formation conductivity.

15. The method of claim 14, wherein the measure is based at least in part on attenuation or phase shift of the transmitted electromagnetic energy.

16. The method of claim 11, wherein the information includes a distance to a formation boundary or existing well.

17. The method of claim 11, wherein said deriving includes extracting an AC response at twice a frequency of the transmitted electromagnetic energy.

18. An electromagnetic energy detector that comprises:

a looped optically-interrogated temperature sensor; and a conductive element thermally coupled to and surrounding the sensor, the conductive element being electrically shorted at opposites ends of a sensor loop and having a temperature response to incident electromagnetic energy, wherein said temperature response is produced by an electrical current that flows through the conductive element along the sensor loop and through the shorted ends; and wherein said electrical current is induced by the incident electromagnetic energy.

19. The detector of claim 18, wherein the conductive element is a conductive coating on the sensor.

20. The detector of claim 18, wherein the sensor comprises one or more loops of an optical fiber.

21. The detector of claim 20, wherein the conductive element is a conductive coating on the fiber in the loops, each loop being electrically insulated from adjacent loops.

22. The detector of claim 21, further comprising a ferromagnetic material inside the loops.

23. The detector of claim 18, wherein the sensor includes a fiber Bragg grating.

24. The detector of claim 18, wherein the sensor comprises an optical fiber coupled to a distributed acoustic sensing system.

25. The detector of claim 18, further comprising sensor electronics that extract an AC response at twice a frequency of the incident electromagnetic energy.

* * * * *